United States Patent [19]

Chelgren

[11] 4,111,370

[45] Sep. 5, 1978

[54] FUEL INLET FITTING FOR A FUEL INJECTION NOZZLE

[75] Inventor: Walter C. Chelgren, Peoria, Ill.

[73] Assignee: Caterpillar Tractor Co., Peoria, Ill.

[21] Appl. No.: 785,795

[22] Filed: Apr. 8, 1977

[51] Int. Cl.[2] ..... F02M 55/02

[52] U.S. Cl. ..... 239/533.3; 239/600; 285/62; 285/189

[58] Field of Search ..... 239/533.2–533.9, 239/533.11, 533.12, 584, 585, 600; 285/62, 189, 197

[56] References Cited

U.S. PATENT DOCUMENTS

| | | | |
|---|---|---|---|
| 2,658,490 | 11/1953 | Bevis et al. | 123/187.5 |
| 3,159,350 | 12/1964 | Mangold | 239/533.6 |
| 3,224,684 | 12/1965 | Roosa | 239/533.11 |
| 3,325,104 | 6/1967 | Roosa | 239/533.3 |
| 3,363,844 | 1/1968 | Evans | 239/533.3 |
| 3,434,667 | 3/1969 | Chmura | 239/584 X |

FOREIGN PATENT DOCUMENTS

| | | | |
|---|---|---|---|
| 2,026,490 | 9/1970 | France | 239/533.3 |

*Primary Examiner*—Robert W. Saifer

*Attorney, Agent, or Firm*—Wegner, Stellman, McCord, Wiles & Wood

[57] ABSTRACT

In a fuel injection nozzle assembly including a fuel injection nozzle having a cylindrical nozzle barrel with a bore communicating with a nozzle tip and a fuel port formed in the side wall thereof for delivery of pressurized fuel thereto, an integrally-formed fuel inlet fitting is utilized to reduce the number of joints between the fuel supply line and the fuel injection nozzle. The fuel inlet fitting has a fuel passage therethrough and includes a mounting portion at one end having a bore therethrough intersecting the fuel passage in which the nozzle barrel is positioned and a coupling portion at the outer end adapted to be connected to a fuel supply line. An integral constricted connecting portion extends between the mounting and coupling portions and has sufficient ductility to permit deformation thereof as desired. A fuel filter may be positioned within the fuel inlet fitting along the fuel passage if desired.

5 Claims, 3 Drawing Figures

FUEL INLET FITTING FOR A FUEL INJECTION NOZZLE

BACKGROUND OF THE INVENTION

1. Field of the Invention

This invention relates generally to a fuel injection nozzle assembly for use with internal combustion engines and, more particularly, to a one-piece inlet fitting for connecting a fuel supply line to the barrel of the fuel injection nozzle.

2. Description of the Prior Art

For efficient operation, internal combustion engines often utilize fuel injection to spray a measured amount of fuel into the engine cylinder under pressure. Typically, the fuel injection nozzle will have a valve element located within a central bore and a fuel supply line connected to a port in the side wall communicating therewith. It is particularly essential that the connection between the fuel injection nozzle and the fuel supply line, which delivers fuel under very high pressure, is fluid tight so that leakage of fuel does not occur.

In the prior art, it has been a common practice to provide the fuel injection nozzle with a fitting seated thereon to which one end of a connector stub was brazed or otherwise secured thereto. The other end of the connector stub was provided with a swivel connector assembly to which the fuel supply line was connected. However, utilization of such a connector stub resulted in an undue number of joints through which pressurized fuel was capable of leaking, if damaged or improperly assembled. In addition, the fuel injection nozzle barrel had to have a special configuration to receive the fitting.

SUMMARY OF THE INVENTION

The present invention is directed to overcoming one or more of the problems as set forth above.

According to the present invention, a fuel injection nozzle has a fuel inlet fitting having a fuel passage therethrough which is integrally formed to have a mounting portion at one end with a bore therethrough intersecting the fuel passage and a coupling portion at the opposite end adapted to provide a connection between the fuel passage and the fuel supply line. The fuel injection nozzle barrel extends through the bore of the mounting portion and is sealed thereto such that the fuel passage is aligned with the fuel inlet port formed in the side wall of the cylindrical nozzle barrel.

In an exemplary embodiment of the invention, the fuel inlet fitting has an integral constricted intermediate portion extending between the mounting portion and the coupling portion having sufficient ductility to allow bending thereof so as to provide variability in the structure for accommodating various angles and clearances when utilized with various types of internal combustion engines.

In a preferred embodiment of the invention, the fuel passage within the coupling portion is partially defined by a counterbore of such size to accommodate an edge-type fuel filter, thereby eliminating the necessity of providing an adjacent adapter for mounting the fuel filter and also eliminating unnecessary joints therebetween.

The fuel inlet fitting is formed from bar stock having a controlled inside diameter and outside diameter wall thickness which can be machined to suitably form the respective portions of the fitting and can be reduced to a size necessary to enable bending of the constricted portion extending between the mounting portion and the coupling portion.

BRIEF DESCRIPTION OF THE DRAWINGS

The details of construction and operation of the invention are more fully described with reference to the accompanying drawings which form a part hereof and in which like reference numerals refer to like parts throughout.

In the drawings.

DESCRIPTION OF THE PREFERRED EMBODIMENT

Figure 1:
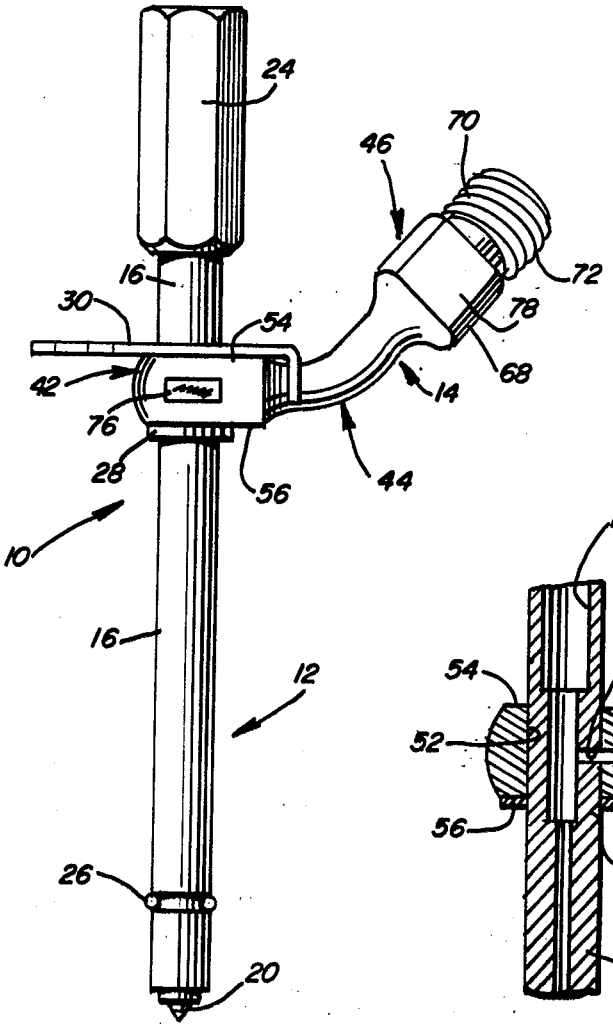
FIG. 1 is an elevational view of a fuel injection nozzle assembly in which a fuel inlet fitting constructed according to the invention has been incorporated.

Referring to the drawings, an exemplary fuel injection nozzle assembly, generally designated 10, for use with an internal combustion engine (not shown) has a fuel injection nozzle, generally designated 12, and a fuel inlet fitting, generally designated 14.

The fuel injection nozzle 12 includes an elongate cylindrical body or barrel 16 having a stepped central bore 18 extending longitudinally therethrough and a nozzle tip 20 at one end thereof having apertures (not shown) through which pressurized fuel delivered through the bore 18 may be sprayed into an engine cylinder. A valve assembly (not shown) is conventionally positioned with the bore 18 for controlling the flow of fuel through the bore 18 to the nozzle tip 20. At the other end of the barrel 16 is a seal cap 24 that communicates with the central bore 18. The seal cap 24 is typically threaded onto the outer periphery of the barrel 16.

Spaced slightly from the nozzle tip 20 is a seal washer 26 disposed within an annular recess formed in the outer circumference of the barrel 16. When the fuel injection nozzle assembly 10 is installed in the internal combustion engine, the barrel 16 will be inserted within a cooperating bore in the engine cylinder head so that the nozzle tip 20 is in communication with the cylinder bore. The annular seal washer 26 provides a seal between the bore and the barrel 16. Seated annularly about the barrel 16 adjacent the fuel inlet fitting 14 is another seal washer 28. Preferably the barrel 16 is provided with a Teflon coating.

Figure 3:
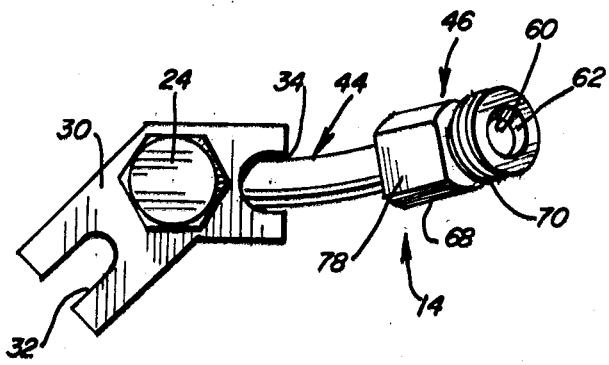
FIG. 3 is a plan view of the fuel injection nozzle and the fuel inlet fitting of FIG. 1.

On the opposite side of the fuel inlet fitting 14 is a clamping bracket 30, shown herein slightly angled. As seen in FIG. 3, the clamping bracket 30 has oppositely disposed bifurcated ends defining slots 32 and 34. When the fuel injection nozzle assembly 10 is in position, a bolt (not shown), which extends through the slot 32, is threaded into the engine head to secure the fuel injection nozzle assembly 10 in proper position. The seal washer 28 will then be clamped down against the engine cylinder head.

Figure 2:
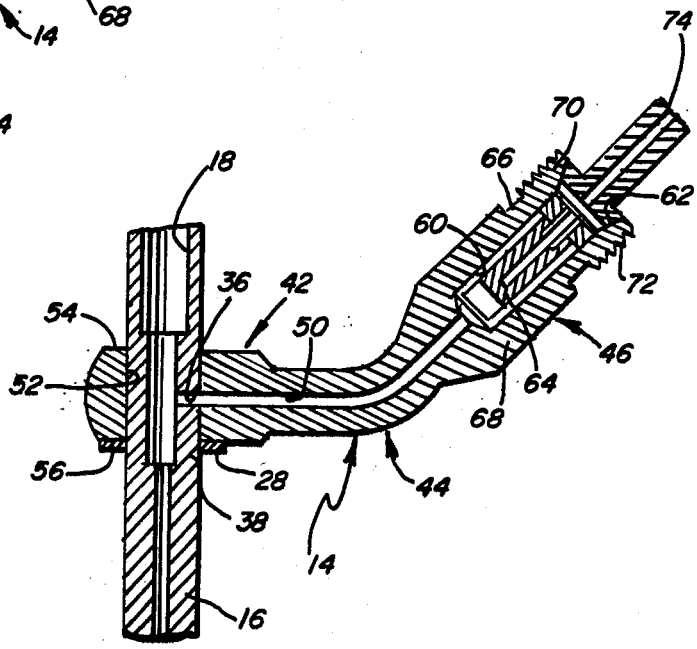
FIG. 2 is a fragmentary cross-sectional view of the assembly of FIG. 1 showing the operative relationship between the fuel injection nozzle and the fuel inlet fitting.

The connection between the fuel inlet fitting 14 and the fuel injection nozzle 12 is more particularly illustrated in FIG. 2. The barrel 16 has a fuel inlet port 36, extending through the side wall 38 thereof, communicating with the central bore 18. The fuel inlet fitting 14 includes an integrally formed enlarged banjo-shaped mounting end portion 42, a constricted tubular connecting line portion 44 and an enlarged coupling end portion 46. Extending completely through the fuel inlet fitting 14 is a fuel passage 50 which is aligned with and communicates with the fuel port 36 when the fuel inlet fitting 14 is properly positioned.

The mounting end portion 42 has a cylindrical bore 52 formed therethrough between the flattened upper and lower surfaces 54 and 56, respectively, through which the barrel 16 extends. The mounting portion 42 is suitably secured to the nozzle barrel 16 to obtain a rigid connection and seal therebetween. The cylindrical barrel 16 and the bore 52 are of similar diameter to provide a tight joint therebetween for brazing to form the assembly.

Within the coupling end portion 46 is a cylindrical counterbore 60 having a conical flared end section 62. Positioned within the counterbore 60 is an edge-type fuel filter 64.

An annular recess 66 separates the inner segment 68 of the coupling portion 46 from the outer segment 70. The outer segment 70 has right-hand threads 72 on its outer circumference for accepting a standard fuel line connector (not shown). When the fuel supply line 74 is connected, it is secured against the flared end section 62 by an internally threaded coupling nut (not shown) tightened onto the threaded outer circumference 72. When the fuel injection nozzle 12 is installed in the engine, the connecting line portion 44 extends through the bracket slot 34 and is thereby held in proper position relative to the engine block. The fuel inlet fitting 14 is constructed so as to have flats 76 formed on opposite sides of the mounting end portion 42 and flats 78 formed on opposite sides of the inner segment 68 of the coupling end portion 46. The flats 76 and 78 provide a convenient means for holding the fuel injection nozzle assembly 10 during manufacture and assembly.

The fuel inlet fitting 14 is turned from a single piece of bar stock or tubing by cold forming or any other acceptable metal working process. Preferably, the fuel inlet fitting 14 is machined from a single piece of bar stock because of the controlled inside diameter and outside diameter wall thickness required for high pressure applications. Initially, the bar stock is large enough to form the outside diameter of the banjo-shaped mounting portion 42 and to permit use of the filter 64 within the coupling portion 46. The connecting line portion 44 is constricted so as to be sufficiently ductile to permit bending thereof.

When the fuel injection nozzle assembly 10 is installed on the engine cylinder head, the clamping bracket 30 is operative to maintain the fuel inlet fitting 14 extending through the slot 34 in proper position and provide some degree of protection to the connection between the nozzle barrel 16 and the fuel inlet fitting 14. The clamping bracket 30 is permanently fixed to the upper portion of barrel 16 prior to attachment of fuel inlet fitting 14. Further, the clamping bracket 30, the barrel 16 and the fuel inlet fitting 14 may be fixed together by brazing the fuel inlet fitting 14 to the barrel 16 to form a fuel injection nozzle unit which can be easily and conveniently installed in a relatively short time.

The embodiment of the invention in which an exclusive property or privilege is claimed is defined as follows:

1. In combination with a fuel injection nozzle including a nozzle barrel having an axial bore communicating with a nozzle tip, a cylindrical external surface and a fuel port formed in the side wall thereof extending radially from the axial bore to a point at the cylindrical external surface permitting delivery of pressurized fuel thereto, an elongate integrally-formed unitary fuel inlet fitting having a fuel passage therethrough comprising a mounting portion at one end having a cylindrical bore intersecting said fuel passage defined by a cylindrical internal surface thereof, a coupling portion at the opposite end having a separable connecting means for joining said fuel inlet fitting to a fuel supply line with said fuel passage communicating with said fuel supply line, and a constricted connecting portion between said mounting portion and said coupling portion having sufficient ductility to permit deformation thereof as desired, the cylindrical external surface of the nozzle barrel and the internal surface of the mounting portion having substantially the same diameter to make a tight fit when said nozzle barrel is inserted through said mounting portion and said fuel passage is aligned with said fuel port to communicate therewith, and means for sealing the two annular joints defined between the cylindrical external surface of the nozzle barrel and the cylindrical internal surface of the mounting portion at the upper and lower surfaces of the mounting portion, whereby there are no other joints along the fitting except at the end thereof where the inlet fitting is connected to the fuel supply line.

2. The fuel inlet fitting of claim 1 wherein a fuel filter is seated in said fuel passage in said fitting.

3. The fuel inlet fitting of claim 2 wherein the end of said fuel passage within said coupling portion is enlarged to accept said filter.

4. The fuel inlet nozzle of claim 1 further including a bracket for mounting said fuel nozzle positioned on one side of said fuel inlet fitting remote from said nozzle tip and a seal washer positioned about said nozzle barrel on the other side of said fuel inlet fitting, said bracket, seal washer and fuel inlet fitting being fixed together with said fuel injection nozzle to form a complete, inseparable fuel injection nozzle assembly, which is installed as a unit on an engine block.

5. In combination with a fuel injection nozzle including a nozzle barrel having an axial bore communicating with a nozzle tip, a cylindrical external surface and a fuel port formed in the side wall for delivery of pressurized fuel to the bore, an integrally-formed fuel inlet fitting having a fuel passage therethrough comprising a mounting portion at one end having a cylindrical bore defined by a cylindrical internal surface and intersecting one end of said fuel passage, a coupling portion at the opposite end of said fuel inlet fitting having a separable connecting means for joining said inlet fitting to a fuel supply line with said fuel passage communicating with said fuel supply line, and a constricted connecting portion between said mounting portion and said coupling portion having sufficient ductility to permit deformation thereof as desired, said coupling portion having a cylindrical counterbore defining the other end of said fuel passage, said counterbore having a diameter greater than the remainder of said fuel passage and having a conical flared end section, a fuel filter within said counterbore and of substantially the same diameter, the fuel supply line having a diameter greater than said counterbore such that the end thereof engages said flared end section and seals therewith when said connecting means is positioned to tightly join said fuel supply line thereto, the cylindrical external surface of the nozzle barrel and the internal surface of the mounting portion having substantially the same diameter to make a tight fit when said nozzle barrel is inserted through said mounting portion and said fuel passage is aligned with said fuel port to communicate therewith, and means for sealing the two annular joints defined between the cylindrical external surface of the nozzle barrel and the cylindrical inner surface of the mounting portion at the upper and lower surfaces of the mounting portion, whereby there are no joints along the fitting except at the end thereof where the inlet fitting is connected to the fuel supply line.

* * * * *